US011696067B2

(12) United States Patent
Shen et al.

(10) Patent No.: US 11,696,067 B2
(45) Date of Patent: Jul. 4, 2023

(54) ELECTRONIC DEVICE HAVING LOUDSPEAKER

(71) Applicant: Qisda Corporation, Taoyuan (TW)

(72) Inventors: Jun-Ming Shen, Taoyuan (TW); Jin-Fu Lee, Taoyuan (TW); Min-Wen Hong, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 17/095,811

(22) Filed: Nov. 12, 2020

(65) Prior Publication Data

US 2021/0176559 A1 Jun. 10, 2021

(30) Foreign Application Priority Data

Dec. 6, 2019 (CN) ..... 201911241179.9

(51) Int. Cl.
*H04R 1/28* (2006.01)
*H04R 1/02* (2006.01)

(52) U.S. Cl.
CPC ..... *H04R 1/2896* (2013.01); *H04R 1/025* (2013.01); *H04R 2400/11* (2013.01)

(58) Field of Classification Search
CPC . H04R 1/02; H04R 1/025; H04R 1/08; H04R 1/403; H04R 1/028; H04R 1/2896; H04R 2201/021; H04R 2201/023; H04R 5/02; H04R 5/023; H04R 2205/021; H04R 2499/11; H04R 2499/15; H04R 2400/11; B60R 11/0217; B60R 2011/0045; H04S 7/40
USPC ..... 381/87, 332, 333, 334
See application file for complete search history.

(56) References Cited

U.S. PATENT DOCUMENTS

2009/0242322 A1* 10/2009 Tsai ..... F16F 1/373 181/207
2011/0280432 A1* 11/2011 Tracy ..... H04R 1/02 381/395
2013/0016865 A1 1/2013 Yu
2014/0072158 A1* 3/2014 Yamada ..... G03B 21/14 353/15

FOREIGN PATENT DOCUMENTS

CN 101841751 A * 9/2010 ..... G09F 9/00
CN 103686024 A 3/2014

OTHER PUBLICATIONS

Office action of counterpart application by SIPO dated Jul. 11, 2022.

* cited by examiner

*Primary Examiner* — Ahmad F. Matar
*Assistant Examiner* — Sabrina Diaz

(57) ABSTRACT

An electronic device including a holder, a first buffer element, a second buffer element and a loudspeaker is provided. The holder includes a first section and a second section perpendicular to the first section. The first section and the second section are respectively provided with a first opening and a second opening. The first buffer element is disposed in the first opening of the first section. The second buffer element is disposed in the second opening of the second section. The loudspeaker is supported on the housing by the holder. The first buffer element is connected to the loudspeaker, and the second buffer element is connected to the housing.

18 Claims, 6 Drawing Sheets

ELECTRONIC DEVICE HAVING LOUDSPEAKER

This application claims the benefit of People's Republic of China patent application Serial No. 201911241179.9, filed Dec. 6, 2019, the subject matter of which is incorporated herein by reference.

BACKGROUND OF THE INVENTION

Field of the Invention

The invention relates in general to an electronic device, and more particularly to an electronic device provided with a loudspeaker.

Description of the Related Art

Normally, the electronic device makes sound using a loudspeaker. However, along with the advance in technology, as the consumers are getting more and more concerned of their living quality and enjoyment, their expectation of the quality of loudspeaker is also getting higher and higher. However, when the loudspeaker makes sound, the sound is always accompanied by vibration which may easily resonate with other elements of the electronic device. The generated resonation not only affects the quality of the sound and may further affect the operation of other elements.

SUMMARY OF THE INVENTION

The invention is directed to an electronic device capable of effectively avoiding the vibration generated by the loudspeaker being transmitted to the housing through the holder.

According to one aspect of the present invention, an electronic device is provided. The electronic device includes a holder, a first buffer element, a second buffer element and a loudspeaker. The holder includes a first section and a second section perpendicular to the first section. The first section and the second section are respectively provided with a first opening and a second opening. The first buffer element is disposed in the first opening of the first section. The second buffer element is disposed in the second opening of the second section. The loudspeaker is supported on the housing by the holder. The first buffer element is connected to the loudspeaker, and the second buffer element is connected to the housing.

According to another aspect of the present invention, an electronic device is provided. The electronic device includes a housing, a holder, a loudspeaker and a buffer element. The holder is provided with an opening. The loudspeaker is supported on the housing by the holder. The buffer element is disposed in the opening of the holder and is connected to the loudspeaker. The buffer element includes a body provided with an annular notch through which the body is disposed in the opening of the holder. In the axial direction of the opening, the length of the annular notch is greater than the length of the opening.

The above and other aspects of the invention will become better understood with regard to the following detailed description of the preferred but non-limiting embodiment(s). The following description is made with reference to the accompanying drawings.

DETAILED DESCRIPTION OF THE INVENTION

A number of embodiments of the invention are disclosed below with accompanying drawings. For the invention to be understood clearly, many details of practices are explained in the following disclosure. However, it should be understood that the details of practices are not for limiting the invention. That is, in some embodiments of the invention, the details of practices are not necessary. To simplify the drawings, some generally known structures and elements are schematically illustrated. Unless otherwise specified, element designations common to different drawings can be regarded as corresponding elements. These drawings are for describing the connection relationship between the elements of the embodiments, and the dimension scales used in the accompanying drawings are not based on actual proportion of the elements.

Figure 1:
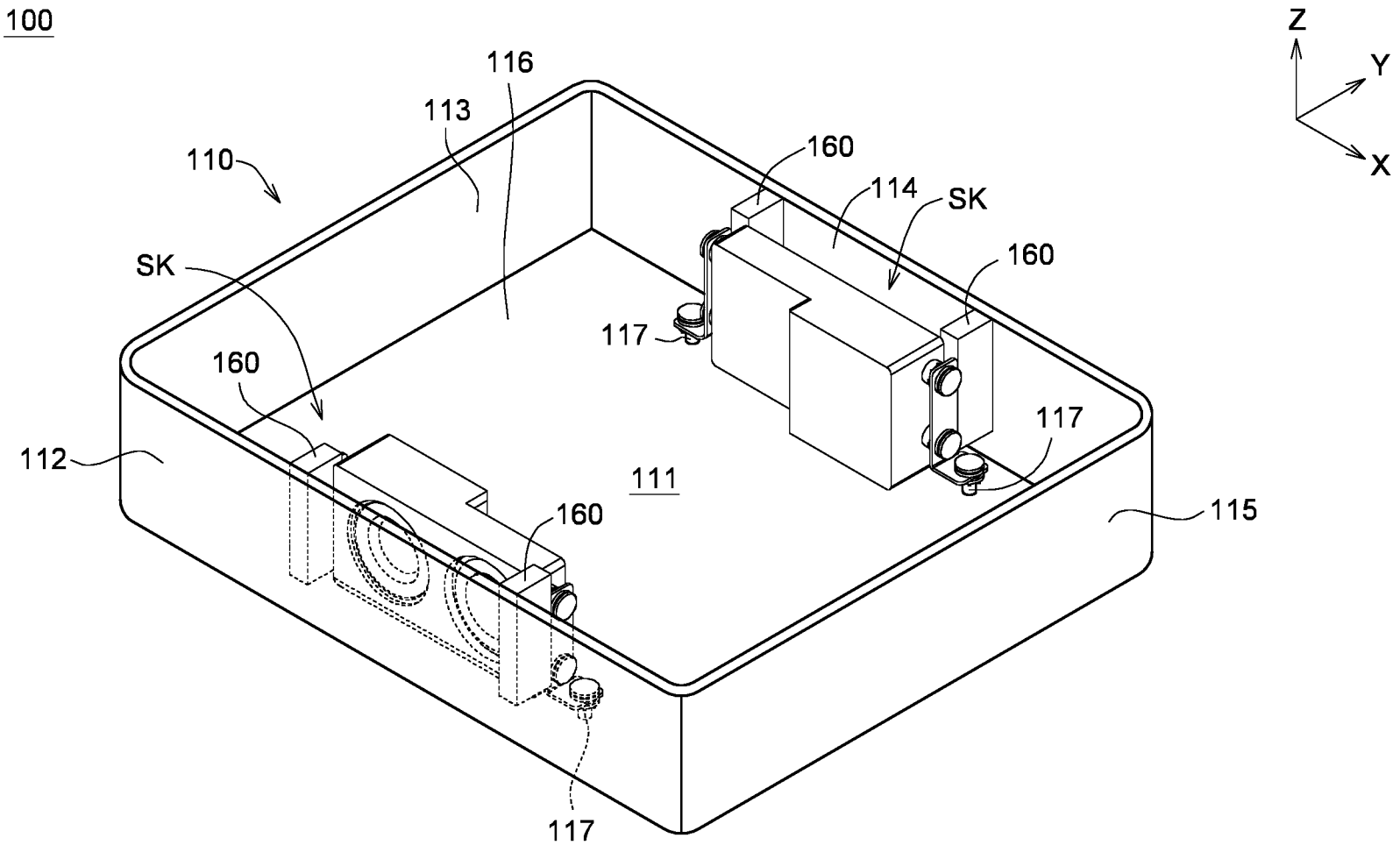
FIG. 1 is a 3D schematic diagram of an electronic device according to an embodiment of the present invention.

Referring to FIG. 1, a 3D schematic diagram of an electronic device 100 according to an embodiment of the present invention is shown. The electronic device 100, such as personal computer, laptop, audio device, projector, or display, includes a housing 110 and a loudspeaker module SK and can make sound using the loudspeaker module SK which is disposed on the housing 110.

In an embodiment, the housing 110 may include side plates 112, 113, 114 and 115 and a bottom plate 116. The side plates 112, 113, 114 and 115 and the bottom plate 116 are connected to define an internal space. The loudspeaker module SK can be disposed in the internal space 111 of the housing 110. In a specific embodiment, the housing 110 includes a supporting column 117 disposed on the bottom plate 116, and the loudspeaker module SK can be fixed on the corresponding supporting column 117 and disposed in the internal space 111 of the housing 110.

In the present embodiment, the electronic device 100 may include two loudspeaker modules SK respectively making sound towards the side plates 112 and 114 disposed oppositely. Generally speaking, when the loudspeaker of the loudspeaker module SK makes sound, vibration is generated more likely in the sound direction. Therefore, the electronic device 100 may further include an elastomer 160 interposed between the loudspeaker module SK and the housing 110. For example, with respect to the loudspeaker module SK making sound towards the side plate 112, the elastomer 160 can be interposed between the loudspeaker module SK (such as supported by the holder) and the side plate 112 of the housing 110. To avoid the drawing being too complicated, the following descriptions are exemplified by only one loudspeaker module SK.

Figure 2:
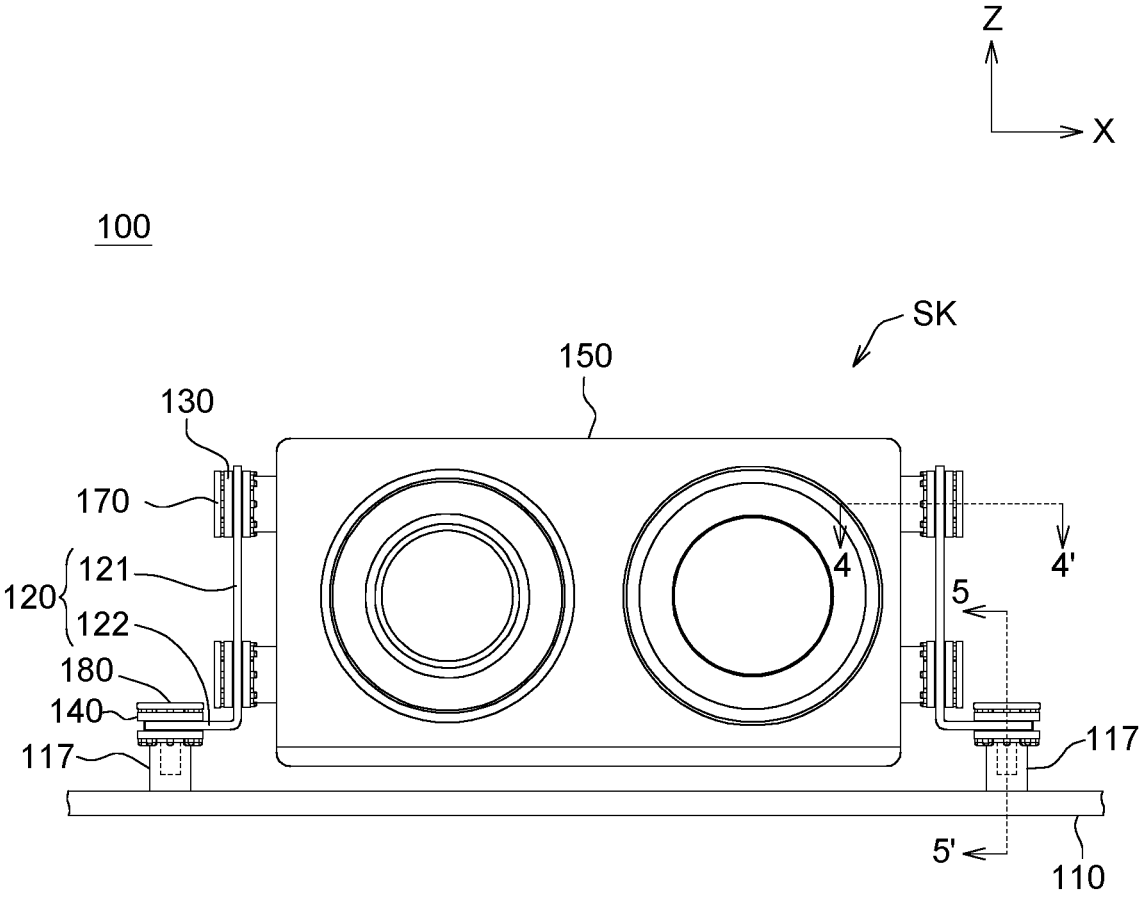
FIG. 2 is a schematic side view of the electronic device of FIG. 1.
Figure 3:
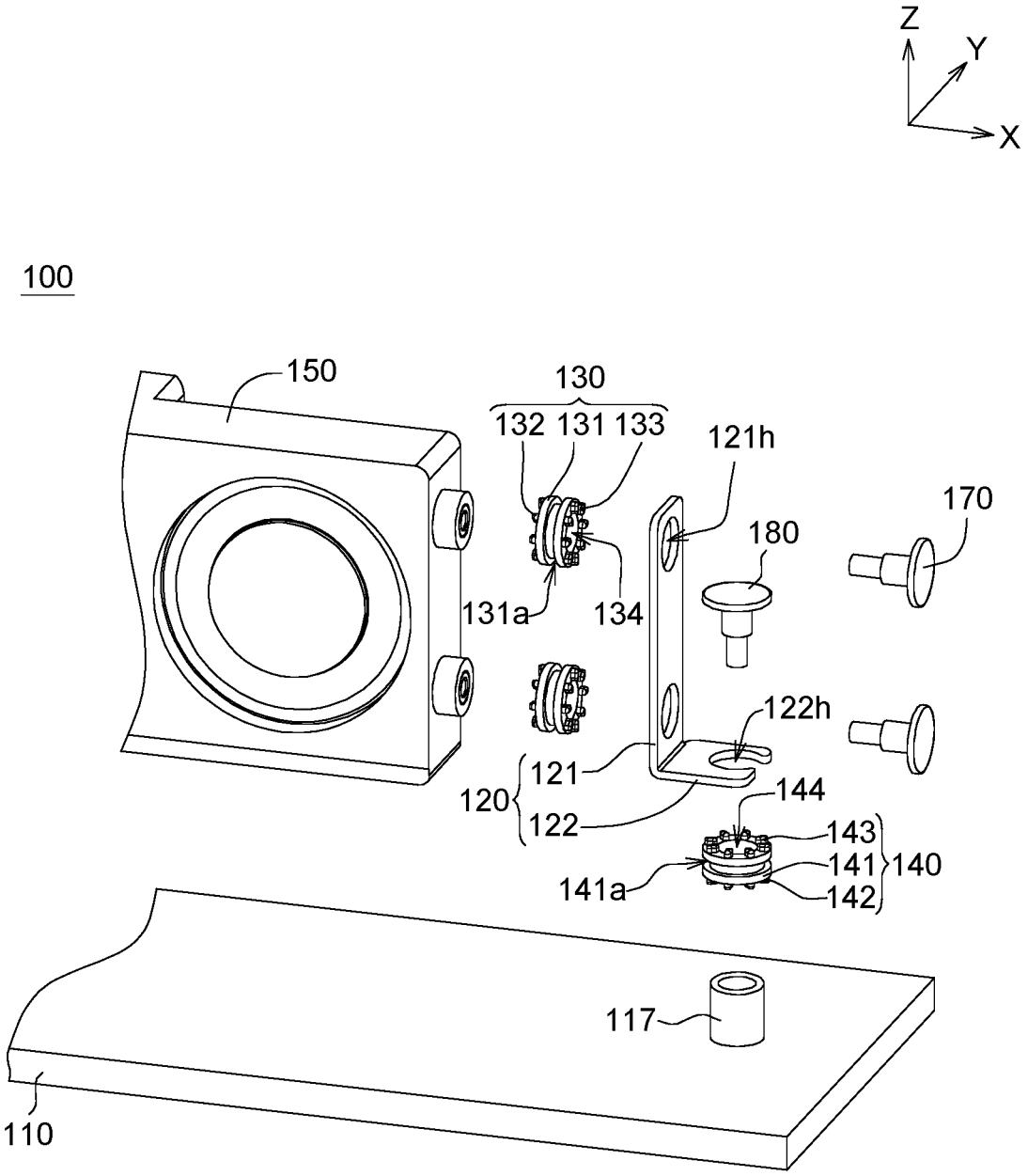
FIG. 3 is an explosion diagram of the electronic device of FIG. 2.

FIG. 2 is a schematic side view of the electronic device 100 of FIG. 1. FIG. 3 is an explosion diagram of the electronic device 100 of FIG. 2. Refer to FIG. 2 and FIG. 3, the loudspeaker module SK includes a holder 120, a first buffer element 130, a second buffer element 140, a loudspeaker 150, a first fixing member 170 and a second fixing member 180.

The loudspeaker 150 can be supported by the holder 120 and disposed in the housing 110. The holder 120 includes a first section 121 and a second section 122 perpendicular to the first section 121. The holder 120 is L-shaped. In the present embodiment, the electronic device 100 may include two holders 120 respectively disposed on two opposite sides of the loudspeaker 150, but the present invention is not limited thereto.

The first buffer element 130 is interposed between the loudspeaker 150 and the first section 121; and the second buffer element 140 is interposed between the second section 122 and the housing 110 (the supporting column 117). The material of the first buffer element 130 and the second buffer element 140 includes but is not limited to rubber or foam. The first buffer element 130 and the second buffer element 140 are configured to absorb and avoid the vibration generated by the loudspeaker 150 being transmitted to the housing 110 through the holder 120 and resonating with other elements on the housing 110.

Refer to FIG. 3. The first section 121 of the holder 120 is provided with an opening 121*h*, the second section 122 is provided with the second opening 122*h*, and the first opening 121*h* and the second opening 122*h* respectively define an axial direction. For example, the axial direction of the first opening 121*h* is parallel to the X axis, and the axial direction of the second opening 122*h* is parallel to the Z axis. Moreover, the sound direction of the loudspeaker 150 is perpendicular to the axial direction of the first opening 121*h* and the axial direction of the second opening 122*h*, respectively. The first buffer element 130 is disposed in the first opening 121*h* of the first section 121 and is further connected to the loudspeaker 150. The second buffer element 140 is disposed in the second opening 122*h* of the second section 122 and is further connected to the housing 110.

Specifically, the first buffer element 130 may include a first body 131, a first vibration damper 132 and a second vibration damper 133, and is provided with a first through hole 134 passing through the first body 131. The first vibration damper 132 and the second vibration damper 133 respectively are located on two opposite sides of the first body 131. The first vibration damper 132 and the second vibration damper 133 respectively may include multiple protrusions circumferentially and symmetrically arranged around the first through hole 134.

The first body 131 is provided with a first annular notch 131*a* disposed on an outer surface of the first body 131. The first body 131 is deformed and makes a part of the body pass through the first opening 121*h*, such that the first annular notch 131*a* is disposed on the first opening 121*h* of the first section 121 enables the first buffer element 130 to be disposed in the first opening 121*h* of the first section 121. When the first buffer element 130 is disposed in the first opening 121*h* of the first section 121, the first fixing member 170 passes through the first through hole 134 of the first buffer element 130 to be fixed on the loudspeaker 150.

The second buffer element 140 may include a second body 141, a third vibration damper 142 and a fourth vibration damper 143, and is provided with a second through hole 144 passing through the second body 141. The third vibration damper 142 and the fourth vibration damper 143 respectively are located on two opposite sides of the second body 141. The third vibration damper 142 and the fourth vibration damper 143 respectively may include multiple protrusions circumferentially and symmetrically arranged around the second through hole 144.

The second body 141 is provided with a second annular notch 141*a* disposed on an outer surface of the second body 141. The second body 141 is deformed and makes a part of the body pass through the second opening 122*h*, such that the second annular notch 141*a* is disposed on the second opening 122*h* of the second section 122 and enables the second buffer element 140 to be disposed in the second opening 122*h* of the second section 122. When the second buffer element 140 is disposed in the second opening 122*h* of the second section 122, the second fixing member 180 passes through the second through hole 144 of the second buffer element 140 to be fixed on the supporting column 117 of the housing 110.

As indicated in FIG. 3, the first section 121 is provided with two first opening 121*h*, the second section 122 is provided with a second opening 122*h*, and each of the first buffer element 130, the second buffer element 140, the first fixing member 170 and the second fixing member 180 of the electronic device 100 has a quantity of corresponding number. However, the quantity of corresponding number is not for limiting the present invention.

Figure 4:
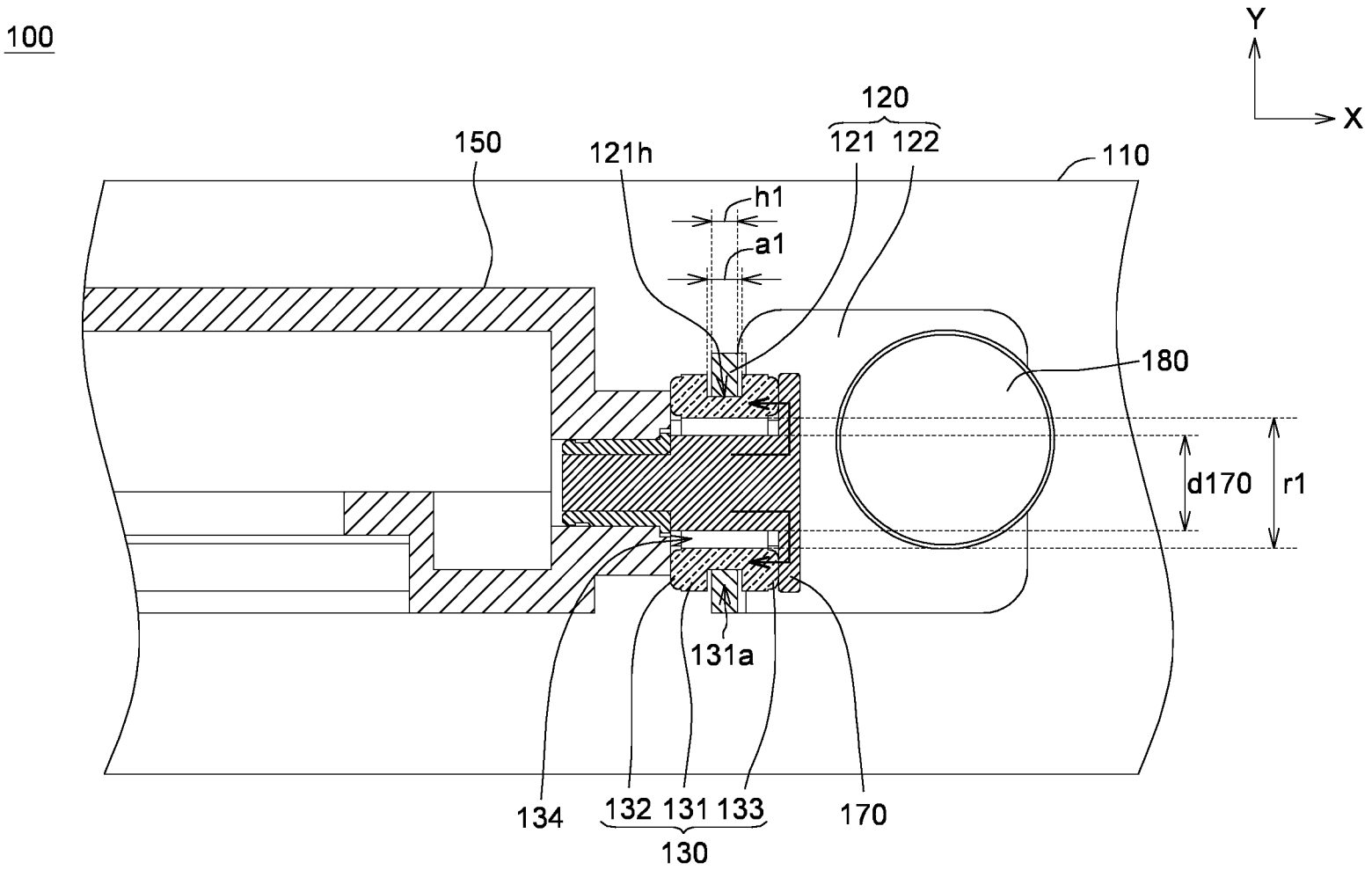
FIG. 4 is a cross-sectional view of an electronic device along the cross-sectional line 4-4' of FIG. 2.

Referring to FIG. 4, a cross-sectional view of an electronic device 100 along the cross-sectional line 4-4' of FIG. 2 is shown. FIG. 4 illustrated the arrangement of the first buffer element 130. The first vibration damper 132 located on one side of the first body 131*a* is cushioned on the loudspeaker 150, and the second vibration damper 133 located on the other side of the first body 131 is cushioned on the first fixing member 170. When the loudspeaker 150 makes sound and generates vibration, the first vibration damper 132 and the second vibration damper 133 can be deformed to avoid vibration being directly transmitted to the first section 121 of the holder 120 through the loudspeaker 150 and/or the first fixing member 170.

Besides, the diameter r1 of the first through hole 134 of the first buffer element 130 is greater than the diameter d170 of the part by which the first fixing member 170 passes through the first through hole 134. That is, the first fixing member 170 is directly connected to the first buffer element 130 through the second vibration damper 133, and when the vibration generated by the loudspeaker 150 is transmitted to the first fixing member 170, vibration will be transmitted to the first buffer element 130 along the arrow direction to prolong the transmission path of vibration.

Moreover, when the first body 131 is disposed in the first opening 121*h* of the first section 121 through the first annular notch 131*a*, the first body 131 does not fully lean on the first section 121. In an example of arrangement, the first body 131 can be tightly engaged with the first opening 121*h* in the radial direction of the first opening 121*h* (the YZ plane). However, the length a1 of the first annular notch 131*a* is greater than the length h1 of the first opening 121*h* in the axial direction of the first opening 121*h* (parallel to the X axis), such that the first body 131 and the first section 121 form a gap in the axial direction of the first opening 121*h*. Illustratively but not restrictively, the gap is in a range of 0.2~0.3 mm.

Through the above arrangement, the transmission path of vibration can be further prolonged, such that the vibration generated by the loudspeaker 150 will not be directly transmitted to the first section 121 of the holder 120. Instead, most vibration will be absorbed by the first buffer element 130, and only a partial amount of vibration will be transmitted the first section 121.

Furthermore, the partial amount of vibration can further be absorbed by other buffer elements, such as another first buffer element 130 located in the first section 121 or another second buffer element 140 located in the second section 122.

Figure 5:
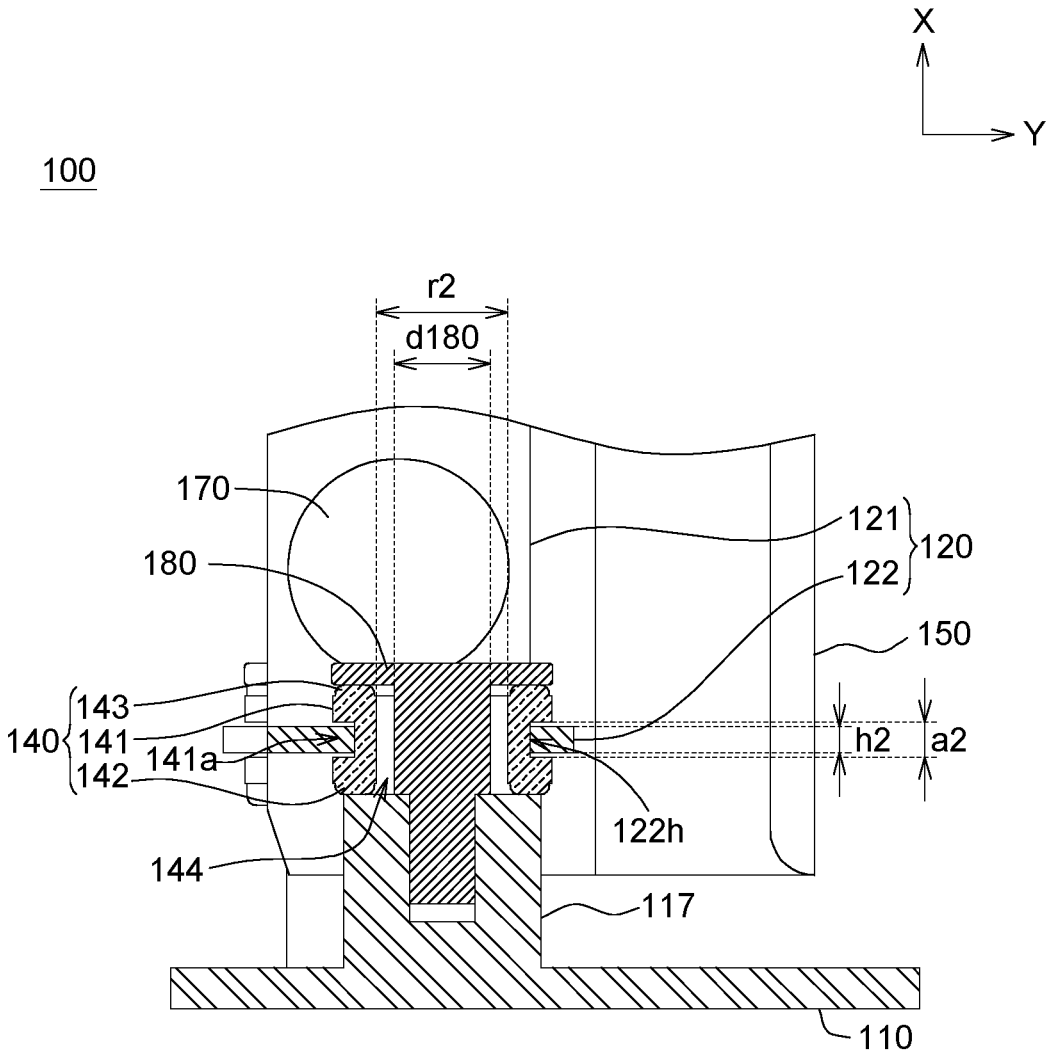
FIG. 5 is a cross-sectional view of an electronic device along the cross-sectional line 5-5' of FIG. 2.

Referring to FIG. 5, a cross-sectional view of an electronic device along the cross-sectional line 5-5' of FIG. 2. FIG. 5 illustrates the arrangement of the second buffer element 140. The third vibration damper 142 located on one side of the second body 141*a* is cushioned on the supporting column 117 of the housing 110, and the fourth vibration damper 143 located on the other side of the second body 141 is cushioned on the second fixing member 180. When a partial amount of vibration is transmitted to the second section 122 from the first section 121, the third vibration damper 142 and the fourth vibration damper 143 can be deformed to avoid the partial amount of vibration being transmitted to the housing 110.

Besides, the diameter r2 of the second through hole 144 of the second buffer element 140 is greater than the diameter d180 of the part by which the second fixing member 180 passes through the second through hole 144. That is, the second fixing member 180 is directly connected to the second buffer element 140 through the fourth vibration damper 143, and when a partial amount of vibration is transmitted to the second section 122, the remaining amount of vibration will be absorbed by the second buffer element 140, such that the probability of vibration being transmitted to the second fixing member 180 and affecting the housing 110 through the second fixing member 180 will be decreased.

Like the arrangement of the first buffer element 130, when the second body 141 passes through the second opening 122*h* of the second section 122 through the second annular notch 141*a*, the second body 141 does not fully lean on the second section 122. In an example of arrangement, the second body 141 can be tightly engaged with the second opening 122*h* in the radial direction of the second opening 122*h* (the XY plane). However, the length a2 of the second annular notch 141*a* is greater than the length h2 of the second opening 122*h* in the axial direction of the second opening 122*h* (parallel to the Z axis), such that the second body 141 and the second section 122 form a gap in the axial direction of the second opening 122*h*. Illustratively but not restrictively, the gap is in a range of 0.2~0.3 mm. Thus, the remaining amount of vibration can be absorbed by the second buffer element 140, and vibration can be effectively prevented from being transmitted to the housing 110.

In the present embodiment, a two-stage vibration reduction effect can be achieved through the arrangement of an L-shaped holder 120. That is, most vibration generated by the loudspeaker 150 is absorbed by the first buffer element 130 located in the first section 121 and only a partial amount of vibration is transmitted to the second section 122 through the first section 121. Then, the remaining amount of vibration is further absorbed by the second buffer element 140 located in the second section 122. Thus, vibration can be effectively prevented from being transmitted to the housing 110.

The present invention is not limited to the above arrangements. For example, in another embodiment, the first buffer element, the second buffer element, the first fixing member, the second fixing member and the holder can be arranged in different ways to avoid vibration being transmitted to the housing.

Figure 6:
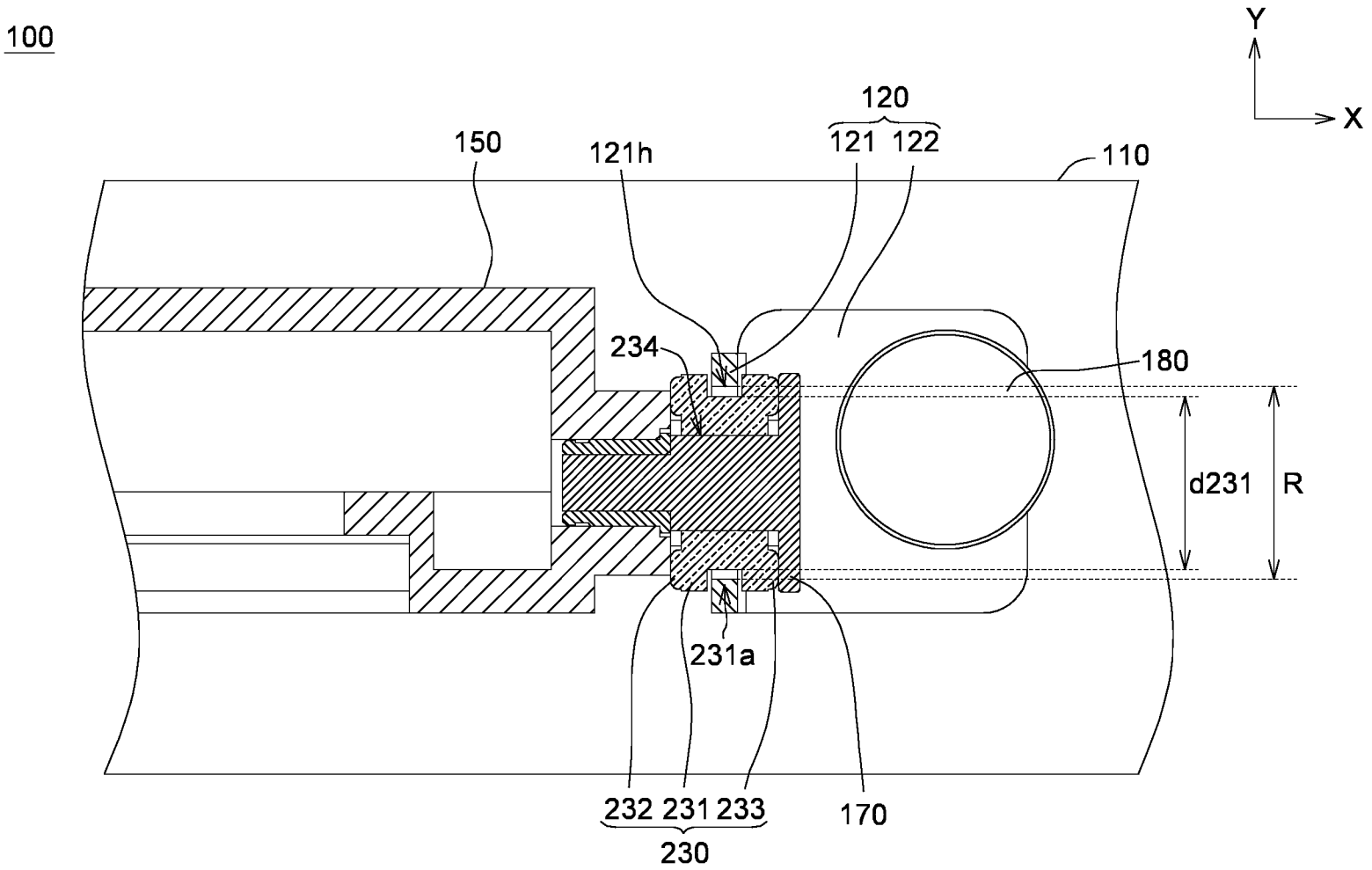
FIG. 6 is a cross-sectional view of an electronic device along the cross-sectional line 4-4' of FIG. 2 according to another embodiment of the present invention.

Referring to FIG. 6, a cross-sectional view of an electronic device 200 along the cross-sectional line 4-4' of FIG. 2 according to another embodiment of the present invention is shown. FIG. 6 illustrates the arrangement of the first buffer element 230. The first buffer element 230 includes a first body 231, a first vibration damper 232 and a second vibration damper 233. The first body 231 is provided with a first annular notch 231*a* through which the first body 231 is disposed in the first opening 121*h* of the first section 121.

Unlike the embodiment of FIG. 2, when the first fixing member 170 passes through the first through hole 234 of the first buffer element 230, the first fixing member 170 is directly connected to the second vibration damper 233 as well as the first body 231.

Moreover, the first body 231 is not tightly engaged with the first opening 121*h* in the radial direction of the first opening 121*h* (the YZ plane). Conversely, the diameter R of the first opening 121*h* of the first section 121 is greater than the diameter d231 of the part by which the first body 231 is disposed in the first opening 121*h*, such that the first body 231 and the first section 121 form a gap in the radial direction of the first opening 121*h*. Illustratively but not restrictively, the gap is in a range of 0.2~0.3 mm.

Through the above arrangement, the first buffer element 23 and the first section 121 of the holder 1200 can be separated from each other without affecting the assembly of the electronic device, hence greatly decreasing the probability of vibration being transmitted to the first section 121 of the holder 120. Additionally, the arrangement of the second buffer element can be similar to that of the first buffer element 230. That is, the diameter of the second opening of the second section 122 is greater than the diameter of the part by which the second body is disposed in the second opening. Although a partial amount of vibration may be transmitted to the first section 121 and the second section 122, the partial amount of vibration still can be absorbed by another first buffer element 230 and/or another second buffer element and will not affect the housing 110.

Besides, the first buffer element 130 of FIG. 4 can be replaced by the first buffer element 230 of FIG. 6. That is, the present invention is not limited to the above embodiments, and the arrangement of the present invention can be a combination of the above embodiments.

Through the above embodiments, the loudspeaker is supported by an L-shaped holder and disposed in the housing, and the generated vibration can be absorbed by the first buffer element and the second buffer element, such that a two-stage vibration reduction effect can be achieved and the vibration reduction performance can be greatly increased. On the other hand, the buffer element is not tightly engaged with the holder in each direction. Instead, a gap is formed between the buffer element and the holder. The gap prolongs the transmission path of vibration and decreases the probability of vibration being transmitted to the housing.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electronic device comprising:

a housing;

a holder comprising a first section and a second section perpendicular to the first section, wherein the first section and the second section are respectively provided with a first opening and a second opening;

a first buffer element disposed in the first opening of the first section, the first buffer element comprising a first body and provided with a first through hole through the first body, the first body having a first inner wall forming the first through hole;

a second buffer element disposed in the second opening of the second section;

a loudspeaker supported on the housing by the holder, wherein the first buffer element is connected to the loudspeaker, and the second buffer element is connected to the housing; and a first fixing member passing through the first through hole and fixed on the loudspeaker, wherein the first fixing member is separated from the first inner wall by an interval, wherein the first body is provided with a first annular notch through which the first body is disposed in the first opening of the first section, and the first annular notch has a length greater than a length of the first opening in an axial direction of the first opening, wherein the first body and the first section form a gap in the axial direction of the first opening, wherein the first buffer element further comprises a first vibration damper located on one side of the first body, and the first vibration damper is cushioned on the loudspeaker and includes multiple protrusions.

2. The electronic device according to claim 1, wherein a sound direction of the loudspeaker is perpendicular to the axial direction of the first opening of the first section and an axial direction of the second opening of the second section.

3. The electronic device according to claim 1, further comprising an elastomer, wherein the elastomer is cushioned between the holder and the housing in a sound direction of the loudspeaker.

4. The electronic device according to claim 1, wherein the holder has a quantity of two respectively disposed on two opposite sides of the loudspeaker.

5. The electronic device according to claim 1, wherein the first body is tightly engaged with the first opening in a radial direction of the first opening.

6. The electronic device according to claim 5, the first through hole has a diameter greater than a diameter of a part by which the first fixing member passes through the first through hole.

7. The electronic device according to claim 1, wherein the first opening has a diameter greater than a diameter of a part by which the first body passes through the first opening.

8. The electronic device according to claim 7, wherein the first through hole has a diameter greater than a diameter of a part by which the first fixing member passes through the first through hole.

9. The electronic device according to claim 1, wherein the second buffer element comprises a second body provided with a second annular notch through which the second body is disposed in the second opening of the second section, and the second annular notch has a length greater than a length of the second opening in an axial direction of the second opening.

10. The electronic device according to claim 9, wherein the second body is tightly engaged with the second opening in a radial direction of the second opening.

11. The electronic device according to claim 10, further comprising a second fixing member, wherein the second buffer element is provided with a second through hole, the second fixing member passes through the second through hole and is fixed on the housing, and the second through hole has a diameter greater than a diameter of a part by which the second fixing member passes through the second through hole.

12. The electronic device according to claim 9, wherein the second opening has a diameter greater than a diameter of a part by which the second body is disposed in the second opening.

13. The electronic device according to claim 12, further comprising a second fixing member, wherein the second buffer element is provided with a second through hole, the second fixing member passes through the second through hole and is fixed on the housing, and the second through hole has a diameter greater than a diameter of a part by which the second fixing member passes through the second through hole.

14. An electronic device comprising:

a housing;

a holder provided with an opening;

a loudspeaker supported on the housing by the holder;

a buffer element disposed in the opening of the holder and connected to the loudspeaker, the buffer element comprising a body provided with an annular notch through which the body is disposed in the opening of the holder, the annular notch having a length greater than a length of the opening in an axial direction of the opening, and the buffer element provided with a through hole through the body, the body having an inner wall forming the through hole; and a fixing member passing through the through hole and fixed on the loudspeaker, wherein the first fixing member is separated from the first inner wall by an interval, wherein the body and the holder form a gap in the axial direction of the opening, wherein the buffer element further comprises a first vibration damper located on one side of the body, and the first vibration damper is cushioned on the loudspeaker and includes multiple protrusions.

15. The electronic device according to claim 14, wherein the body is tightly engaged with the opening in a radial direction of the opening.

16. The electronic device according to claim 15, wherein the through hole has a diameter greater than a diameter of a part by which the fixing member passes through the through hole.

17. The electronic device according to claim 14, wherein the opening has a diameter greater than a diameter of a part by which the body is disposed in the opening.

18. The electronic device according to claim 17, wherein the through hole has a diameter greater than a diameter of a part by which the fixing member passes through the through hole.

* * * * *